United States Patent [19]

Koch et al.

[11] 4,354,530

[45] Oct. 19, 1982

[54] CROSSING THREAD SUPPLY SYSTEM FOR A WEAVING MACHINE

[75] Inventors: Bernhard R. Koch, Horgenberg; Erich Vogelbacher, Horgen, both of Switzerland

[73] Assignee: Sulzer Brothers Ltd., Winterthur, Switzerland

[21] Appl. No.: 157,086

[22] Filed: Jun. 6, 1980

[30] Foreign Application Priority Data

Jun. 11, 1979 [EP] European Pat. Off. ..... 79101878

[51] Int. Cl.[3] ..... D03D 5/00; D03D 47/40

[52] U.S. Cl. ..... 139/54

[58] Field of Search ..... 139/54, 102, 103, 109, 139/110

[56] References Cited

U.S. PATENT DOCUMENTS 124,632 3/1872 Saatweber ..... 139/103
625,206 5/1899 Schaum ..... 139/103
2,710,631 6/1955 Flamand ..... 139/54
3,320,978 5/1967 Kobayashi ..... 139/54

FOREIGN PATENT DOCUMENTS 2421748 11/1974 Fed. Rep. of Germany ..... 139/54

*Primary Examiner*—Henry Jaudon
*Attorney, Agent, or Firm*—Kenyon & Kenyon

[57] ABSTRACT

The crossing thread supply system for the weaving machine employs a rotatable bobbin carrier and a thread tensioning means for controlling a thread pay-out from a bobbin on the carrier as a function of thread tension. The tensioning means employs a control lever which is pivotable under the influence of the paid-out thread and a pivoting lever which engages via a pawl with a ratchet wheel connected to the bobbin carrier. The control lever serves to pivot the pivoting lever when moved to an innermost position. This disengages the pawl from the ratchet wheel to permit indexing of the ratchet wheel and bobbin carrier.

11 Claims, 7 Drawing Figures

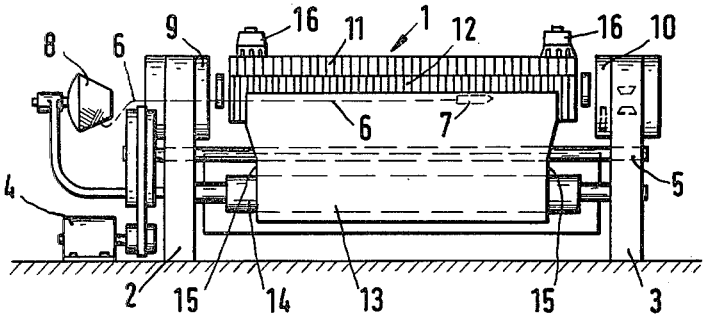
Fig.1
Fig.7
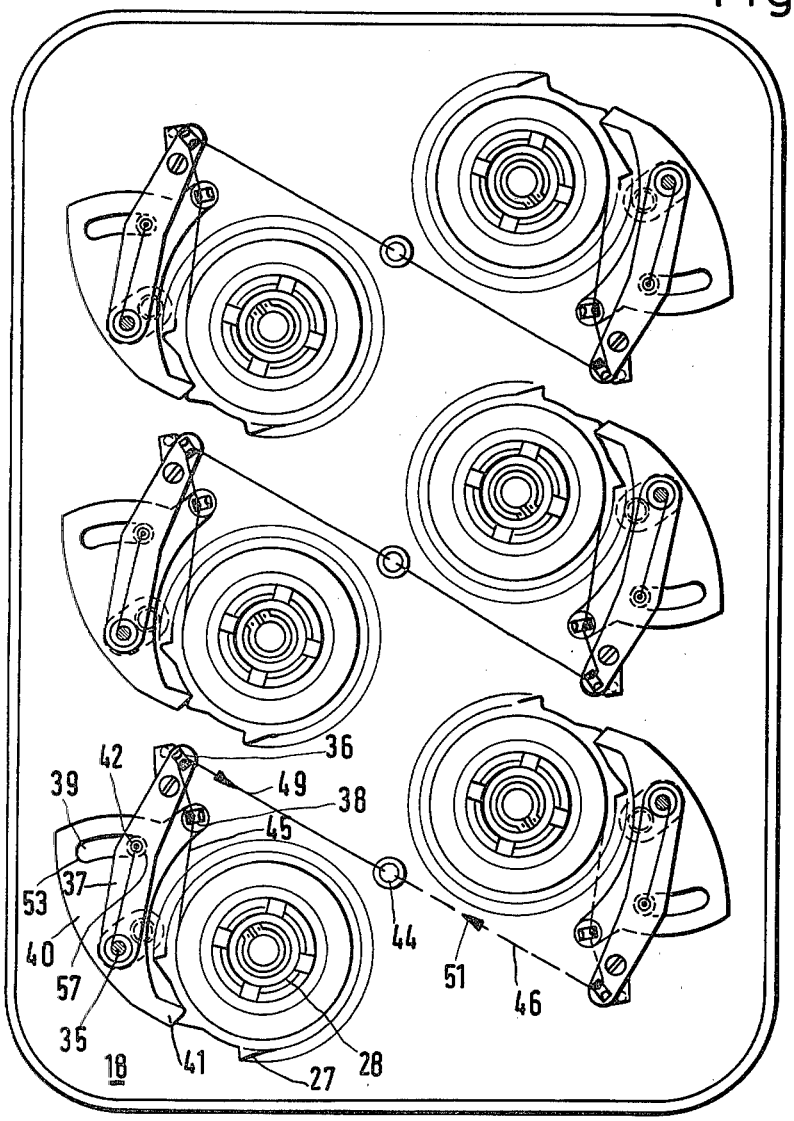

Fig. 5
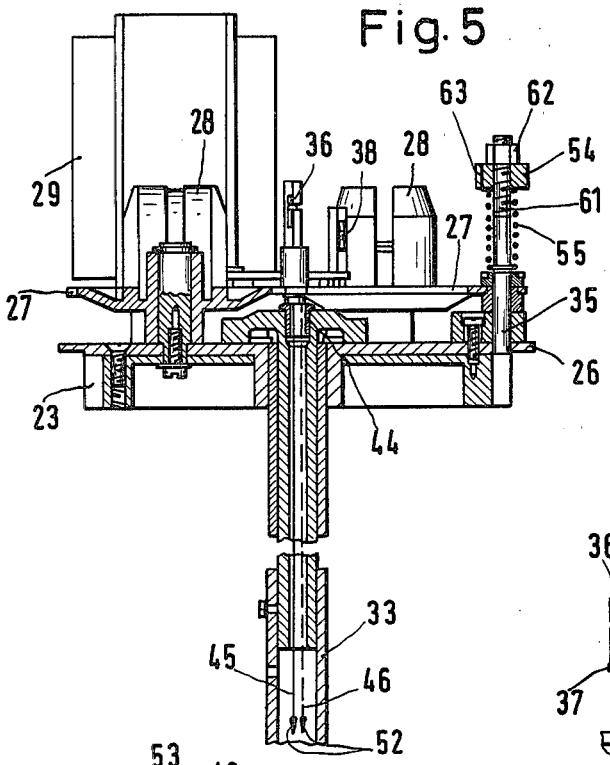
Fig. 6
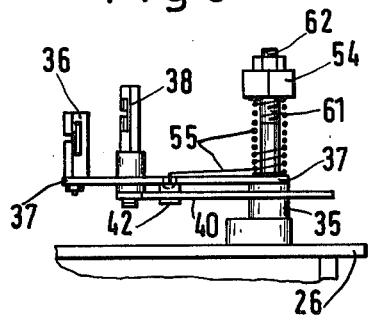
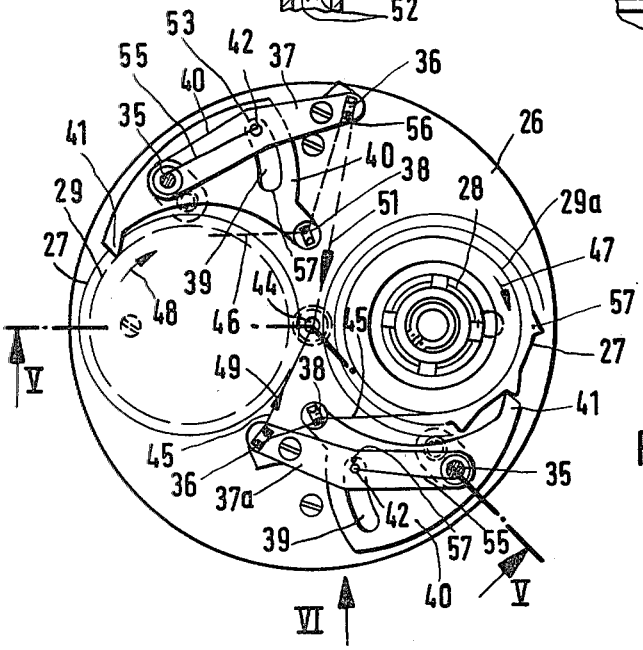
Fig. 4

CROSSING THREAD SUPPLY SYSTEM FOR A WEAVING MACHINE

This invention relates to a crossing thread supply system for a weaving machine. More particularly, this invention relates to a crossing thread supply system for a weaving machine for making fabric containing leno weaves.

Heretofore, it has been known to provide weaving machines with a crossing thread supply system, for example as described in Swiss Pat. No. 227,334. In such cases, a crossing thread is drawn from a reserve bobbin over a thread brake for delivery to the weaving machine. The thread is then passed over a spindle whorl for incorporation into a shed of warp yarns formed by heddles of the weaving machine. However, during rotation of the spindle whorl or during movement of the heddles from an extreme position into a closed shed position, the crossed threads lose their tension more or less and may droop. This, in turn, may cause disturbances in the weaving operation.

Accordingly, it is an object of the invention to provide a thread supply system in which reserve threads can be continuously supplied under tension.

It is another object of the invention to provide a crossing thread supply system of relatively simple construction for mounting on weaving machines.

It is another object of the invention to provide a crossing thread supply system for supplying threads under continuous tension to a weaving machine.

Briefly, the invention provides a crossing thread system for a weaving machine which is comprised of at least one pair of thread reserve bobbins for paying out threads and a spring biased thread tensioning means for controlling each thread pay-out as a function of thread tension. The system allows the paid-off crossing thread to be supplied continuously under a desired thread tension. Thus, the thread can no longer droop and become caught on any machine part. As a result, the weaving operation of the weaving machine will not be disturbed.

In one embodiment, the crossing thread supply means includes a rotatable bobbin carrier for receiving a reserve thread bobbin and a thread tensioning means for controlling the thread pay-out from the bobbin as a function of thread tension. In this case, it is possible to mount the bobbin under especially low friction so that the thread can be kept under low tension and be subject to relatively low stresses.

The tensioning means includes a control lever having a thread eyelet which is movable under the influence of the tension in the thread passing through the eyelet to move from an outer position towards an inner position. In addition, the tensioning means includes a spring biasing the lever towards the outer position and means for indexing the carrier in response to the control lever moving into the inner position. The indexing means allows the carrier to move ahead incrementally to pay-out a fresh length of thread to the weaving machine while the control lever moves back to an outer position.

These and other objects and advantages will become more apparent from the following detailed description taken in conjunction with the accompanying drawings wherein:

FIG. 1 illustrates a schematic view of a weaving machine employing a pair of crossing thread supply systems constructed in accordance with the invention;

FIG. 4 illustrates a top view of a single bobbin carrier of the thread supply system of FIG. 2;

FIG. 5 illustrates a view taken on line V—V of FIG. 4;

FIG. 6 illustrates a front view of a thread tensioning means taken in the direction indicated by the arrow VI of FIG. 4; and FIG. 7 illustrates a plan view of a modified crossing thread supply system constructed in accordance with the invention.

Figure 3:
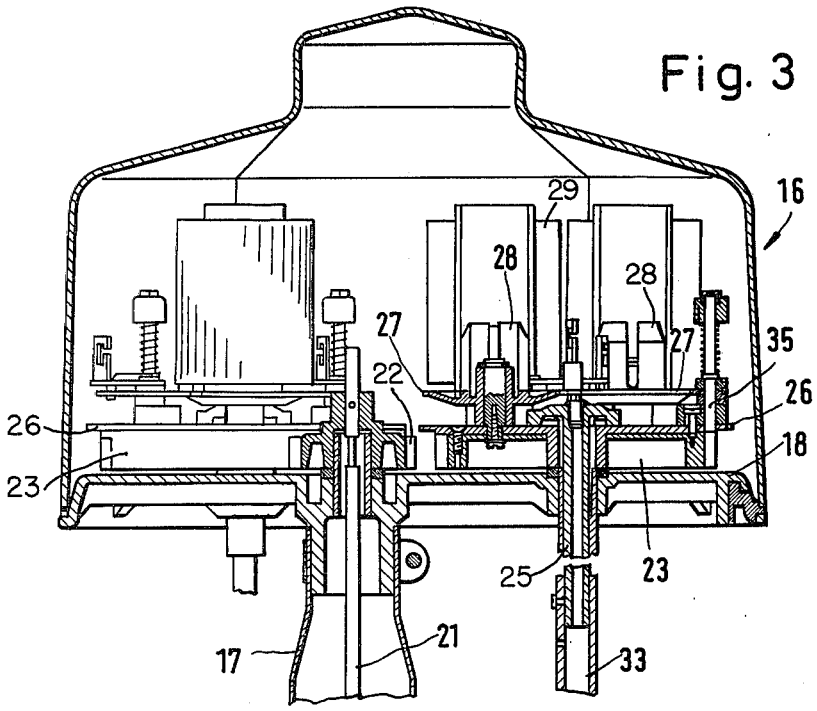
FIG. 3 illustrates a view taken on line III—III of FIG. 2.

Referring to FIG. 1, the weaving machine is constructed in conventional fashion. As shown, the weaving machine includes two machine cheeks 2, 3 across which a main shaft 5 is mounted and driven via a motor 4. A weft thread 6 is drawn off a stationary bobbin 8 by means of a projectile 7 and is inserted into a shed of warp yarns formed within the machine by means of a multiplicity of heedles 11. The projectile 7 is picked into the shed by a picking mechanism 9 on one side of the machine and received in a catch mechanism 10 on the opposite side of the machine. A suitable read 12 is provided for beating up the picked weft thread and a cloth beam 14 is provided for winding up the resulting fabric 13. As shown, the two edges 15 of the fabric 13 contains leno weaves, for example half twist weaves or twist leno weaves. These weaves are produced by two crossing thread supply systems 16.

Figure 2:
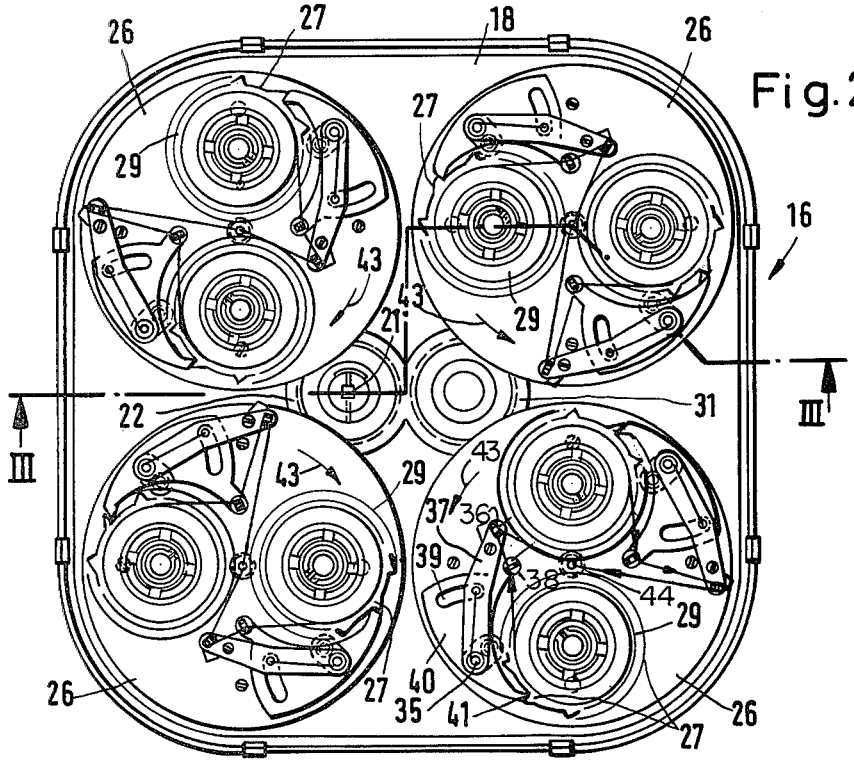
FIG. 2 illustrates a top view of a crossing thread supply system constructed in accordance with the invention.

Referring to FIGS. 2 and 3, each crossing thread supply system is secured on a support 17 connected with the frame of the weaving machine 1. As indicated in FIG. 3, each supply system 16 contains a base plate 18 which is secured in suitable manner to the support 17. A drive shaft 21 for the supply system 16 is housed in the support 17 and passed through the plate 18. This shaft 21 is driven off the weaving machine in known manner and continuously rotates during operation of the weaving machine 1.

A pinion 22 is mounted on the drive shaft 21 and meshes with two gears 23 (only one of which is shown in FIG. 3). Each gear 23 is mounted on an axle 25 journalled in the base plate 18 and carries a disk 26 at the upper surface for rotation therewith. As shown in FIG. 2, an intermediate gear 31 is also in mesh with the pinion 22 as well as with two further gears 23 with disks 26 disposed on the right.

Referring to FIGS. 4 and 5, each disk 26 carries a pair of rotatable bobbin carriers 28 for receiving thread reserve bobbins 29 (only one of which is shown). Each disk 26 is also coupled to a thread guide tube 33 (FIG. 5) through which a thread pair 45, 46 paid-out from the two associated bobbins 29 is guided downward and supplied, for example to a spindle whorl (not shown) and, thereupon, introduced into the weaving machine. As shown, each guide tube 33 extends through the disk 26 at a central point coaxial with the axle 25 (see FIG. 3).

A thread tensioning means is also mounted on each disk 26 adjacent a respective carrier 28 for controlling a thread pay-out from a bobbin 29 as a function of thread tension. As shown in FIG. 4, each tensioning means includes a control lever 37 which is pivotally mounted on an axle 35 secured to the disk 26. The control lever 37 is provided with a thread eyelet 36 at the free end which is disposed in the path of a thread 45, 46 and is spring biased by a spring 55 to move from an inner position to an outer position opposite to the direction of thread pay-out to impart a tension in the thread. As shown in FIGS. 5 and 6, the spring 55 is wrapped about a threaded extension 61 of the axle 35 with one end anchored in an intermediate point of the control lever 37 and the opposite end 63 anchored in a nut 54 threaded into the axle extension 61. A locking nut 62 is also threaded onto the extension 61 to lock the adjusting nut 54 in in place. The tension of the spring 55 can be adjusted to a desired amount during weaving by turning of the nut 54.

Referring to FIG. 4, each tensioning means is also provided with a means for indexing a carrier 28 in response to the control lever 37 moving into the inner position. As shown, the indexing means includes a ratchet wheel 27 which is connected to the carrier 28 and a second pivoting lever 40. The ratchet wheel 27 is secured in coaxial relation with the bobbin carrier 28 in any suitable manner for coincident rotation. Each ratchet wheel 27 is mounted in freely rotatable relation on the disk 26 to rotate independently of the rotation of the disk 26. The pivoting lever 40 is mounted on the axle 35 in common with the control lever 37 and carries a thread guide 38 at the free end. The pivoting lever 40 also has a curved slot 39 at an intermediate point and a pawl 41 which engages the ratchet wheel 27. The slot 39 receives a bolt 42 (see FIG. 6) which is secured to the control lever 37 and depends into the slot 39.

The levers 37, 40 are independently pivotable about the axle 35. However, the pivoting lever 40 is caused to pivot with the control level 37 when the control lever 37 moves into an inner position with the bolt 42 abutting against the innermost edge of the slot 39. At this time, the pawl 41 disengages from the ratchet wheel 27.

Referring to FIG. 2, during operation, the four disks 26 of the supply system 16 are set into rotation continuously from the drive shaft 21 via the gears 23 according to the arrows 43 so that pairs of bobbins 29 arranged on the same disk 26 rotate about a thread system 44 disposed at the upper end of a thread guide tube 33.

Referring to FIG. 4, the crossing thread 45 paid-out from the bobbin **29*a* is shown in solid line while the thread 46 paid-out from the bobbin 29 is shown in broken line. The bobbins 29, 29*a* rotate in the direction indicated by the arrows 47, 48. The threads 45, 46 are drawn off in the direction indicated by the arrows 49, 51 and pass through the eyelet 44 into the guide tube 33 and are drawn off downwardly as indicated by the arrows 53 in FIG. 5 to the weaving machine (not shown). As shown in FIG. 4, the thread 45 passes through the eyelet 38 on the pivoting lever 40 and the eyelet 36 on the control lever 37 before passing to the eyelet 44. Likewise, the thread 46 passes through the eyelets 38, 36 of the levers 40, 37** of the other tensioning means.

As shown in the upper part of FIG. 4, before paying-out the thread 46, the control lever 37 is in an outer position so that the bolt 42 is located at the outer end 53 of the slot 39 of the pivoting lever 40. Upon consumption of warp thread or of the crossing thread in the weaving machine, the control lever 37 successively moves towards the inner position against the bias of the spring 55. The thread loop 56 thus becomes shorter and the bolt 42 finally reaches the other end 57 of the slot 39 (i.e. the position shown for the lower control lever **37*a***).

Upon a further inward pivoting of the control lever 37, the pivoting lever 40 is taken along via the bolt 42. Both levers 37, 40 are then pivoted about the axle 35 in a clockwise manner, as viewed, so that the pawl 41 disengages from the ratchet 27 to actuate the play-out of the thread 45. The ratchet wheel 27 then advances by one step in the direction indicated by the arrow 47, i.e. clockwise, under the action of the slight tension in the thread 45. As the tensile stress in the thread 45 then decreases, the control lever 37 is pivoted counter clockwise by the spring 55 as viewed in FIG. 4 with the pivoting lever 40 following in the same direction of rotation. As indicated, the control lever 37 is pivoted to the outer position by the spring 55 so that the bolt 42 strikes the outer end of the slot 39 such that the pivoting lever 40 moves counterclockwise as viewed. The pawl 41 is thus engaged with the next following tooth 57 of the ratchet wheel 27. The ratchet wheel 27 and the associated bobbin 29 are again secured against relative rotation and the process at the levers 37, 40 repeats.

The crossing thread supply means can be used, for example as a complete crossing (leno) system. To this end, a spindle whorl would be connected after the guide tube 33. Alternatively, the supply system may be used in connection with a half-twist device. For this purpose, the thread guide tube 33 would be followed, for example by a leno-edging suspended in the heddles 11 of the weaving frame 1. In this case, the drive shaft 21 and gears 23 of the disk 26 would be eliminated, for example as indicated in FIG. 7 wherein like reference characters indicate like parts as above. In this case, the system contains pairs of disks 26 with associated bobbin parts 29, **29*a* mounted on a base plate 18**.

In the various embodiments, the levers 37, 40, pawl 41 and ratchet wheel 27 serve as a control for the paying-out or pulling off of the crossing threads 45, 46 from the bobbins 29 as a function of the tension of these threads.

It is to be noted that the pivoting movement of the control lever 37 which occurs under spring action allows the differences of length of the crossing threads 45, 46 which result during the rotation of a following spindle whorl, or during an up and down movement of the heddles, to be absorbed and the crossing threads maintained continuously under approximately equal tensile stress.

What is claimed is:

1. A crossing thread supply system for a weaving machine comprising at least one pair of thread reserve bobbins for paying-out threads; and a spring biased thread tensioning means for controlling each thread pay-out as a function of thread tension, said tensioning means including a control lever in the path of a thread from a respective bobbin, said lever being spring biased in a direction opposite to the direction of thread pay-out to impart a tension in the thread, and a pivoting lever actuated from said control lever and having a pawl mounted thereon for actuating the pay-out of a thread from said respective bobbin in response to a predetermined increase in thread tension.

2. A system as set forth in claim 1 which further comprises a ratchet wheel connected to at least one of said bobbins, and wherein said pawl engages with said ratchet wheel.

3. A system as set forth in claim 2 wherein said tensioning means further includes a slot in said pivoting lever and a drive bolt extending from said control lever into said slot of said pivoting lever to engage said pivoting lever with said control lever in an inwardly pivoted position of said control lever.

4. A system as set forth in claim 3 wherein said slot extends over an angle and said bolt engages said pivoting lever with said control lever in an opposite position of said control lever.

5. A system as set forth in claim 3 wherein said slot is curved.

6. A system as set forth in claim 3 wherein said control lever and said pivoting lever are mounted in common on an axle.

7. A system as set forth in claim 1 wherein said tensioning means is adjustable.

8. A system as set forth in claim 1 wherein said pivoting lever has a thread eyelet and said control lever has a thread eyelet, said pivoting lever eyelet being positioned to bend the thread between a bobbin draw-off point and said control lever eyelet whereby said pawl is biased under the thread tension into a locking position relative to said respective bobbin.

9. In a crossing thread supply system for a weaving machine, the combination comprising a rotatable bobbin carrier for receiving a reserve thread bobbin thereon; and a thread tensioning means for controlling a thread pay-out from a bobbin on said carrier as a function of thread tension, said tensioning means including a pivotally mounted control lever having a thread eyelet for passage of a thread from a bobbin on said carrier therethrough, said lever being pivoted under the influence of the tension in a thread passing through said eyelet to move from an outer position towards an inner position, a spring biasing said lever towards said outer position, and means for indexing said carrier in response to said control lever moving into said inner position, said means for indexing including a ratchet wheel connected to said carrier and a second lever having a pawl engaging said ratchet wheel and being movable relative to said control lever to disengage said pawl from said ratchet wheel in response to said control lever moving into said inner position.

10. The combination as set forth in claim 9 wherein said levers are pivotally mounted on a common axle.

11. A crossing thread supply system for a weaving machine comprising at least one pair of thread reserve bobbins for paying-out threads;

a ratchet wheel connected to at least one of said bobbins; and a spring biased thread tensioning means for controlling each thread pay-out as a function of thread tension, said tensioning means including a pivotally mounted control lever having a thread eyelet for passage of a thread from said one bobbin therethrough, said lever being in gear connection with said ratchet wheel, a pivoting lever having a pawl engaging with said ratchet wheel, said pivoting lever being actuated from said control lever in an inwardly pivoted position thereof to form a gear connection between said control lever and said ratchet wheel, an axle having said control lever and pivoting lever mounted thereon in common, a slot in said pivoting lever and a drive bolt extending from said control lever into said slot of said pivoting lever to engage said pivoting lever with said control lever in said inwardly pivoted position.

* * * * *